United States Patent [19]

Bloom et al.

[11] 4,033,905

[45] July 5, 1977

[54] METHOD FOR INCREASING THE CONDUCTIVITY OF ELECTRICALLY RESISTIVE ORGANIC MATERIALS

[75] Inventors: Allen Bloom, East Windsor; Daniel Louis Ross, Princeton, both of N.J.

[73] Assignee: RCA Corporation, New York, N.Y.

[22] Filed: Nov. 5, 1975

[21] Appl. No.: 629,086

[52] U.S. Cl. ..... 252/500; 252/299; 350/160 LC

[51] Int. Cl.[2] ..... H01B 1/00

[58] Field of Search ..... 252/299, 500, 408 LC; 350/160 LC

[56] References Cited

UNITED STATES PATENTS

| | | | |
|---|---|---|---|
| 3,405,001 | 10/1968 | Iler | 252/500 X |
| 3,814,700 | 6/1974 | Aviram et al. | 252/500 X |
| 3,888,566 | 6/1975 | Toriyama et al. | 252/299 X |
| 3,950,264 | 4/1976 | Jones | 252/408 LC |

*Primary Examiner*—Benjamin R. Padgett
*Assistant Examiner*—E. Suzanne Parr
*Attorney, Agent, or Firm*—H. Christoffersen; B. E. Morris

[57] ABSTRACT

Electrically resistive organic materials, e.g. silicone rubber, thermoplastic resins, and liquid crystals, are made more electrically conductive by the addition of an effective amount of a compound of the formula:

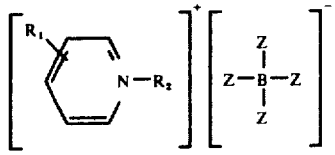

wherein $R_1$ is selected from the group consisting of hydrogen, alkyl, and phenyl-substituted alkyl; $R_2$ is alkyl with 8 – 20 carbon atoms; and Z is selected from the group consisting of phenyl and alkyl-substituted phenyl. The invention is particularly applicable to silicone rubber light valves and liquid crystals.

9 Claims, No Drawings

METHOD FOR INCREASING THE CONDUCTIVITY OF ELECTRICALLY RESISTIVE ORGANIC MATERIALS

FIELD OF THE INVENTION

The invention relates to the use of certain organic compounds to reduce the bulk resistivity of electrically resistive organic materials. More particularly, this invention relates to the use of pyridinium borates to reduce the bulk resistivity of electrically resistive silicone rubbers, thermoplastic resins, and liquid crystals.

BACKGROUND OF THE INVENTION

When using organic materials in the construction of various types of electric devices, e.g., deformable mirror light valves, it is often necessary to lower the bulk resistivity, i.e., increase the conductivity, of the solid organic materials. Conventional techniques for lowering the resistivity of organic materials include the addition of a material such as carbon black, organo-metallic salts or neutral compounds. Use of these materials often has a deleterious effect on desired physical, electrical, and optical properties of the recipient organic materials. For example, adding finely divided conductive particles to silicone rubber results in a catastrophic decrease in the resistivity of the silicone rubber with increasing particle concentrations. This catastrophic decrease renders the silicone rubber unsuitable for any purpose where the resistivity must be selectively decreased.

Deformable mirror light valves are well known devices capable of amplifying the light intensity of an optically projected image, e.g., see U.S. Pat. No. 2,896,507 entitled, "Arrangement for Amplifying the Light Intensity of an Optically Projected Image," which issued July 28, 1959. Generally, the devices are layered structures including, sequentially, a transparent conductor layer, a photoconductor layer, an elastomer layer, a thin flexible layer of conductive metal and a means for applying a voltage across the transparent conductor layer and the flexible layer of conductive metal.

Silicone rubber is often chosen for the elastomer layer in the deformable mirror light valve. However, the high resistivity of silicone rubber, generally about $10^{14}$ ohm-cm to $10^{15}$ ohm-cm, has the disadvantage that real time operation of the deformable mirror light valve under a constant DC bias voltage is not feasible. In order to overcome this disadvantage, a silicone rubber having a resistivity in the range of from about $10^{14}$ ohm-cm to $10^{9}$ ohm-cm would be desirable.

In preparing an electro-optic device, the liquid crystal compounds should be rigorously purified to remove ionic and nonionic impurities which may react to degrade the liquid crystal compounds, such as by decomposition, and the like. For commercially acceptable liquid crystal cells, the liquid crystal compounds should be purified to a resistivity of at least $1 \times 10^{11}$ ohm-cm. The dielectric relaxation frequency of a liquid crystal material is related to the resistivity thereof and determines the switching rate. A high dielectric relaxation frequency is desirable for certain applications, e.g., dynamic scattering displays, which require rapid decay time. It would be desirable to dope the liquid crystal with a non-deleterious material to reduce the resistivity to a suitable value, such as below $10^{10}$ ohm-cm.

PRIOR ART

The use of tetrabutylammonium tetraphenylborate as an ionic dopant in room temperature nematic liquid crystals, e.g., p-methoxybenzylidene-p-n-butylaniline, has been described in a paper by Roger Chang and John M. Richardson of the North American Rockwell Science Center, Thousand Oaks, Cal. U.S. Pat. No. 3,405,001 describes the use of certain hydrocarbon onium salts of tetraarylboron on the surface of various materials to inhibit the development of an electrostatic charge. Neither publication, however, teaches the use of a pyridinium tetraphenylborate for decreasing the bulk resistivity of electrically resistive silicone rubbers, thermoplastic resins and/or liquid crystals.

SUMMARY OF THE INVENTION

The bulk resistivity of electrically resistive organic materials, e.g., silicone rubber, thermoplastic resins, and liquid crystals, are electrically modified by addition of an effective amount of a compound having the formula:

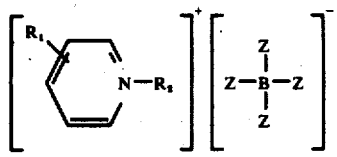

wherein $R_1$ is selected from the group consisting of hydrogen, alkyl, and phenyl-substituted alkyl, $R_2$ is alkyl with 8 – 20 carbon atoms; and Z is selected from the group consisting of phenyl and alkyl-substituted phenyl.

$R_1$ is preferably hydrogen and Z is preferably phenyl. Alkyl as employed here is $C_1$ – $C_4$ alkyl.

DETAILED DESCRIPTION OF THE INVENTION

The pyridinium tetraarylborates of the above formula, used in the present invention, may be prepared by the methods described by J. T. Cross, Analyst, 90, 315 (1965), and in U.S. Pat. No. 3,405,001. The pyridinium tetraarylborates are added to the resistive organic material, e.g. silicone rubbers, thermoplastic resins or liquid crystals, by conventional methods well known to practitioners of the art. Generally, the resistive organic material, if solid, is metled by heating preferably under vacuum or in an inert atmosphere, and the pyridinium tetraarylborate is added to the liquified organic material. Alternatively, the resistive organic material, either solid or liquid, is dissolved in a solvent and the pyridinium tetraarylborate is added to the solution. The solution may be evacuated to remove any trapped gases. The solvent is evaporated off, leaving behind the organic material with the pyridinium tetraarylborate salt dissolved in it.

The solubility limit for hexadecylpyridinium tetraphenylborate is about 0.5% by weight in RTV-910 silicone rubber commercially available from General Electric Co. The cured silicone rubber with this concentration of hexadecylpyridinium tetraphenylborate had a resistivity of $3.2 \times 10^{13}$ ω-cm. Other pyridinium tetraarylborates should give similar results. Generally about 0.001 to 0.5% by weight constitutes an effective amount. The exact upper limit is determined by the solubility of the additive in the specific material.

The pyridinium tetraphenylborates are more soluble than the corresponding stearates, or halides and teraalkylammonium tetraphenylborates, e.g. tetrabutylammonium tetraphenylborate, tetrahexylammonium tetraphenylborate, and tetraheptylammonium tetraphenylborate, are less hydroscopic than the corresponding ammonium halides.

The invention is illustrated by the following examples, but it is to be understood that the invention is not meant to be limited to the details disclosed therein.

EXAMPLE 1

Liquid crystal mixtures consisting of 1:1 weight mixture of p-methoxybenzylidene-p'-butylaniline and p-ethoxybenzylidene-p'-butylaniline, 0.52 wt. % of p-anisaldehyde used as an aligning agent, and varying amounts of 1-n-hexadecylpyridinium tetraphenylborate were placed in a $SnO_2$ -coated 1 × 1 in. glass cell with a 0.5 mil (0.0127 cm) spacer. The liquid crystal/-hexadecylpyridinium tetraarylborate mixture was prepared by dissolving the tetraarylborate salt in the liquid crystal mixture. The resistivity was determined by using a low measuring voltage of 0.1 v rms 160 $H_z$ ac, to facilitate ohmic behavior. The calculations were based on the cell acting as a parallel plate capacitor. The resistivity of the cell decreased with an increase in the weight % of the hexadecylpryidinium tetraphenylborate in the liquid crystal mixture as shown in Table 1.

TABLE 1

Resistivity of Doped Liquid Crystal Mixtures

| Weight % 1-n-hexadecyl-pyridinium tetraphenyl-borate | Resistivity (Ω-cm) |
|---|---|
| 0 | $1.0 \times 10^{11}$ |
| $1.26 \times 10^{-3}$ | $3.1 \times 10^{9}$ |
| $1.15 \times 10^{-2}$ | $5.1 \times 10^{8}$ |
| $1.10 \times 10^{-1}$ | $5.9 \times 10^{7}$ |

The foregoing illustrates that 1-n-hexadecylpyridinium tetraphenylborate reduced the resistivity of a liquid crystal to a value about $10^{10}$ ohm-cm.

EXAMPLE 2

Liquid crystal mixtures consisting of 1:1 mixture by weight of p-ethoxybenzylidene-p'-butylaniline and p-methoxybenzylidene-p'-butylaniline with 1 wt. % p-methoxybenzylidene-p'-hydroxyaniline as an aligning agent and a resistivity lowering additive were prepared as in Example 1. The results using hexadecylpyridinium tetraphenylborate as the resistivity lowering additive are compared to those obtained using the corresponding 1-n-hexadecylpyridinium bromide as shown in Table 2. The maximum solubility of the bromide in this liquid crystal mixture is about 0.1%, thereby limiting the resistivity obtained with the use of this additive to 5 × $10^8$ ω-cm. Since the tetraphenylborate salt is more soluble in the liquid crystal mixture than the bromide, a lower resistivity can be obtained using the tetraphenylborate salt.

TABLE 2

| Additive | 1-n-Hexadecyl-Pyridinium Bromide | 1-n-Hexadecyl pyridinium Tetraphenyl-borate |
|---|---|---|
| Weight % of additive | 0.1 | 0.3 |
| Test voltage | 15v rms | 15v rms |

TABLE 2-continued

| Additive | 1-n-Hexadecyl-Pyridinium Bromide | 1-n-Hexadecyl pyridinium Tetraphenyl-borate |
|---|---|---|
| Dielectric Relaxation Frequency | 0.8 kHz | 12 kHz |
| Estimated Resistivity | $5 \times 10^8$ Ω-cm | $3 \times 10^7$ Ω-cm |

EXAMPLE 3

Silicone rubber samples were prepared by mixing 50 grams of RTV-602 dimethyl polysiloxane silicone rubber (available from the General Electric Co.) 10 grams of RTV-910 dimethyl silicone oil diluent (available from the General Electric Co.) and the indicated amount of a pyridinium tetraphenylborate as shown in Table 3 below. The ingredients were thoroughly mixed. Heating in an inert atmosphere or under vacuum was used to dissolve the tetraphenylborate salt, although not always necessary. 21 drops of SRC-04 Catalyst (available from the General Electric Co.) were added, and the solutions were stirred and evacuated. The resultant mixtures were then poured onto an aluminum plate and allowed to cure. The resistivities of the cured pyridinium tetraphenylborate-containing silicone rubber samples cast on the aluminum plates were determined according to ASTM-D257 standard using a guardring resistivity measuring device (a Keithley model 6105 resistivity adaptor available from the Keithley Co.). Voltages in multiples of 30 v from 30 to 120 v were applied, the resulting currents were measured, and the resistivity was calculated. The results of the sample measurements are shown in Table 3.

TABLE 3

Resistivity of Silicone Rubber Samples

| Additive[a] | Weight % of additive | Resistivity of cured sample (Ω-cm) |
|---|---|---|
| None | — | $1.3 \times 10^{15}$ |
| 1-n-Hexadecyl-pyridinium | 0.3 | $2.2 \times 10^{13}$ |
| 1-n-Octadecyl-pyridinium | 0.3 | $4.0 \times 10^{12}$ |
| 1-n-Hexadecyl-4-(3-phenyl-propyl)-pyridinium | 0.3 | $4.7 \times 10^{12}$ |

[a]All additives are tetraphenylborate salts. It can thus be seen that the tetraphenylborate reduced the resistivity of the silicon rubber samples to a value below about $10^{14}$ ohm-cm.

Although a dimethyl silicone rubber was used in the above example, any silicone rubber containing an effective amount of a pyridinium tetraarylborate as described above should exhibit a lowered resistivity.

EXAMPLE 4

18 gram portions of Pentalyn H, a thermoplastic polyester resin, derived from pentaerythritol and abietic acid and manufactured by the Hercules Co., together with certain amounts of various tetraphenylborate salts as shown in Table 4 below, were dissolved in 12.5 milliliters of an organic solvent and dip coated onto 1 × 3 inch (2.54 × 7.62 cm) chromium coated glass slides. The slides were then dried for 7 days at 20°C. in a desiccator to remove both the solvent and any moisture present. The surface was charged with a negative corona having an 8000 volt potential for 30 sec. The samples were placed in a Monroe Electrostatic voltmeter (available from the Monroe Co.) and the surface potentials were read as a function of time. The resistivities were then calculated. The results are summarized in Table 4.

Table 4

Resistivity of Pentalyn H with Added Tetraphenylborate Salts

| Tetraphenylborate salt added | Solvent | Weight % tetraphenylborate salt | Resistivity (Ω-cm) |
|---|---|---|---|
| None | Toluene | — | $>1.9 \times 10^{15}$ |
| None | 2-methoxyethylacetate | — | $>1.9 \times 10^{15}$ |
| 1-n-Dodecylpyridinium | 2-methoxyethylacetate | 0.58 | $2.5 \times 10^{14}$ |
| 1-n-Hexadecylpyridinium | 2-methoxyethylacetate | 0.56 | $3.3 \times 10^{14}$ |
| 1-n-Hexadecylpyridinium | Toluene | 0.90 | $4.5 \times 10^{12}$ |
| 1-n-Octadecylpyridinium | 2-methoxyethylacetate | 0.33 | $3.7 \times 10^{14}$ |

This shows that since tetraphenylborate reduced the resistivity of the thermoplastic polyester resin to a value of about $10^{15}$ ohm-cm, similar results should be obtained using as additives, compounds such as 1-n-hexadecyl-4-methyl-pyridinium tetraphenylborate, 1-n-octadecyl-4-t.butyl-pyridinium tetraphenylborate, 1-n-hexadecyl-4-ethylpyridinium tetra-p-tolylborate, and 1-n-hexadecyl-3-propylpyridinium tetra-p-ethylphenylborate.

We claim:

1. A method for increasing the conductivity of resistive organic material selected from the group consisting of silicone rubber, polyester thermoplastic resin and liquid crystals, which comprises adding to said organic material a resistivity-lowering compound of the formula:

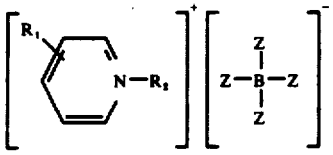

wherein $R_1$ is selected from the group consisting of hydrogen, $C_1C_4$ alkyl, and phenyl-substituted $C_1$-$C_4$ alkyl $R_2$ is an alkyl group having 8–20 carbon atoms; and Z is selected from the group consisting of phenyl, and $C_1$-$C_4$ alkyl-substituted phenyl.

2. The method of claim 1, wherein Z is phenyl.

3. The method of claim 1, wherein said organic material is a silicone rubber.

4. The method of claim 1, wherein said organic material is a thermoplastic resin.

5. The method of claim 1, wherein said organic material is a liquid crystal composition.

6. A silicone rubber, having a resistivity below about $10^{14}$ ohm-cm, containing an effective amount of a resistivity lowering compound of claim 1.

7. A thermoplastic resin, having a resistivity below about $10^{15}$ ohm-cm, containing an effective amount of a resistivity lowering compound of claim 1.

8. A liquid crystal composition, having a resistivity below $10^{10}$ ohm-cm, containing an effective amount of a resistivity lowering compound of claim 1.

9. A method for increasing the conductivity of resistive organic material selected from the group consisting of silicon rubber and thermoplastic resins which comprises adding to said organic material an effective amount of a resistivity-lowering compound of the formula

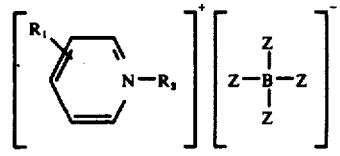

wherein $R_1$ is hydrogen, alkyl phenyl substituted alkyl wherein the alkyl group has 1–4 carbon atoms, $R_2$ is an alkyl group of 8–20 carbon atoms and Z is phenyl or alkyl-substituted phenyl wherein the alkyl group has 1–4 carbon atoms.

* * * * *